United States Patent [19]

Fastner et al.

[11] 3,965,964

[45] June 29, 1976

[54] METHOD OF CONTINUOUSLY CASTING STEEL STRANDS, IN PARTICULAR SLABS

[75] Inventors: Thorwald Fastner; Manfred Pammer, both of Linz, Austria

[73] Assignee: Vereingte Osterreichische Eisen- und Stahlwerke-Alpine Montan Aktiengesellschaft, Linz, Austria

[22] Filed: Jan. 2, 1975

[21] Appl. No.: 538,140

[30] Foreign Application Priority Data

Jan. 11, 1974 Austria ..... 206/74

[52] U.S. Cl. ..... 164/83

[51] Int. Cl.[2] ..... B22D 11/04

[58] Field of Search ..... 164/83, 273 R, 273 M, 164/282, 283 R, 283 S, 283 MI

[56] References Cited

UNITED STATES PATENTS

| | | | |
|---|---|---|---|
| 3,461,950 | 8/1969 | Michelson | 164/83 X |
| 3,721,288 | 3/1973 | Vogt et al. | 164/83 |
| 3,766,963 | 10/1973 | Rossi | 164/282 X |

*Primary Examiner*—Ronald J. Shore
*Attorney, Agent, or Firm*—Brumbaugh, Graves, Donohue & Raymond

[57] ABSTRACT

A method of continuously casting steel strands, in particular slabs in a continuous casting plant, involves the withdrawal of the strand from a cooled, oscillating mold and the further cooling of it in a secondary cooling zone arranged to follow the mold. The oscillation frequency of the mold and the lowering speed of the strand are coordinated with each other so that the distance between the oscillation marks, defined as the quotient of the lowering speed in m/min to the mold frequency in strokes/min, amounts to maximumly 0.018 m. The oscillation marks that occur on the strand surface constitute dangerous points of weakness which ultimately lead to the formation of cracks. By the method of the present invention it is possible to eliminate the crack formation altogether or at least to reduce said risk to a minimum.

11 Claims, 1 Drawing Figure

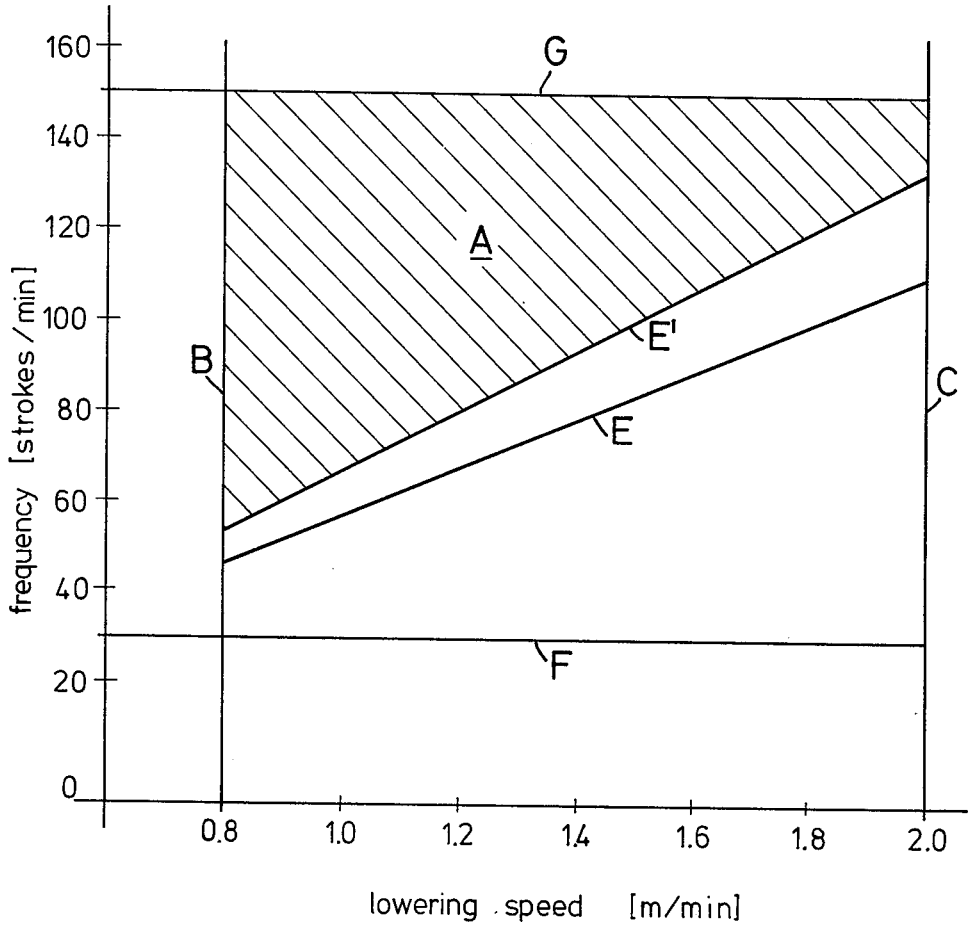
160
140
120
100
80
60
40
20
0
frequency [strokes / min]
G
A
B
E'
E
C
F
0.8
1.0
1.2
1.4
1.6
1.8
2.0
lowering speed [m/min]

METHOD OF CONTINUOUSLY CASTING STEEL STRANDS, IN PARTICULAR SLABS

BACKGROUND OF THE INVENTION

The invention relates to a method of continuously casting steel strands, in particular slabs, in a continuous casting plant, wherein the strand is withdrawn from a cooled oscillating mold containing molten steel covered by a casting slag layer or a casting powder layer, and wherein said strand is further cooled in a secondary cooling zone arranged to follow the mold.

With the oscillation of the mold, so-called oscillation marks occur on the surface of the withdrawn strand. These oscillation marks have an adverse effect on the strand surface with the known method of operation. When the strand is being cooled in the secondary cooling zone it runs through a temperature range in which it is deformable only to a minor degree. This range is called the red shortness range and in killed, unalloyed steels it lies between approx. 800°C and 950°C. In this range the strand is liable to crack formation, in particular at its edges and in an area close to said edges. The oscillation marks on the strand surface constitute points of discontinuity, both as regards the surface condition and as regards the temperature. The marks are formed by strand regions in which the slag particles, carried along out of the mold, become deposited to an increased degree as compared to the rest of the surface and in which scale settles. The result is that these points are cooled less by the cooling water sprayed onto the strand. Moreover, these temperature discontinuities have the consequence that expansions which occur in the cast strand become effective almost exclusively in the oscillation marks because these points have, on account of their higher temperature, a lower resistance to deformation. Thus the mechanical stresss exerted upon the strand when said strand is being withdrawn from the secondary cooling zone is not uniform. Whereas the strand surface hardly increases in length between the oscillation marks, the oscillation marks themselves are extended and overextended. As a consequence thereof fine surface cracks occur which, although not visible with the naked eye, constitute dangerous points of weakness, which, on account of tension concentrations, easily result in severe surface defects, i.e. in cracks having a depth of a few mm. These cracks then have to be removed by scarfing, which entails a loss of material and high costs.

SUMMARY OF THE INVENTION

The present invention aims at avoiding the above mentioned disadvantages and difficulties and it is its object to provide a continuous casting method in which the risk of crack formation is either eliminated or reduced to a minimum.

The invention is based on the knowledge that the oscillation frequency of the mold and the lowering speed of the strand have to be coordinated in a very specific manner, so that oscillation marks only occur at a certain maximum distance from each other. This correlation according to the invention assures that the distance between the oscillation marks, defined as the quotient of the lowering speed (m/min) to the mold frequency (strokes/min), amounts to maximumly 0.018 m, preferably to maximumly 0.015 m.

BRIEF DESCRIPTION OF THE DRAWING

The foregoing and other features of the present invention will be more readily apparent from the following detailed description and drawing of a graph showing the correlation according to the invention between lowering speed and the mold frequency.

DESCRIPTION OF EXEMPLARY EMBODIMENTS

In the continuous casting of slabs normally a lowering speed lying between 0.8 and 2.0 m/min is used. In this case the oscillation frequency of the mold lies between 30 and 150 strokes per minute. Thus the correlation of the invention says e.g. that at a lowering speed of 0.8 m/min the mold frequency is not to be lower than 44.5 strokes/min, and at a lowering speed of 2.0 m/min the mold frequency is not to be lower than 112 strokes/-min. The correlation according to the invention is illustrated schematically in the accompanying graph, wherein on the abscissa there is plotted the lowering speed of the strand in m/min and on the ordinate there is plotted the mold frequency in strokes/min.

The lines B and C delimit the range of the lowering speed from 0.8 to 2.0 m/min, which range is eligible according to the invention, and the lines F and G delimit the mold frequency ranges eligible in practice. Field A of the graph, which at its lower end is limited by line E, thus illustrates the value pairs of the lowering speed and the mold frequency to be applied according to the invention. In the field A the distance between the oscillation marks amounts to maximumly 0.018 m. The line E′ is another limit line denoting a distance of the oscillation marks from each other of maximumly 0.015 m. The range to be preferably applied according to the invention lies in field A above line E′.

The maximum distance between the oscillation marks substantially determines whether or not crack-free slabs can be obtained. A distance as small as possible between the oscillation marks has the advantage that expansions which occur are distributed over a greater number of oscillation marks and thus remain in acceptably small ranges.

Apart from the above mentioned correlation between the lowering speed and the mold oscillation frequency, a certain temperature range and support of the strand lies within the scope of the invention. According to these further features of the invention, cooling of the strand is to be controlled in such a way that the temperature at any point on the strand surface amounts to maximumly 1100°C when the strand emerges from the mold, or if the strand emerges from the mold with a higher temperature, it falls to maximumly 1100°C within 2 minutes at the most. Also the strand, as long as it has a liquid core, is supported at distances of maximumly 280 mm, preferably at distances of maximumly 250 mm, by supporting and guiding rollers.

By the combination of these measures the desired object of avoiding the formation of cracks on the strand surface can be achieved without any difficulties. The reason why the observance of the temperature regulation is important is that the forming scale does not grow into the grain boundaries of the oscillation marks and weaken them when the temperature is below 1100°C. When, according to the invention, the strand surface temperature is kept below 1100°C or when it is lowered within maximumly 2 minutes to less than 1100°C an unfavorable effect of the scale upon the grain boundaries of the oscillation marks is not to be feared any longer.

The above mentioned requirement that the distance between the individual points of support of the strand be maximumly 280 mm apart, preferably of 250 mm, results from the demand that the deformation caused by a bulging of the strand between the supporting rollers be avoided to the largest extent possible. When bulges occur, undesired expansions are the consequence, which in turn constitute a stress on the oscillation marks, as has already been mentioned.

The method of the invention may be used with advantage for all steels capable of being cast continuously. It has proved particularly advantageous for casting slabs having for instance the following chemical composition:

| | |
|---|---|
| C<br>0.09–0.24% by weight | Si<br>0.10–0.40% by weight |
| Mn<br>0.80–1.50% by weight | P<br>0.008–0.030% by weight |
| S<br>0.008–0.030% by weight | Al<br>0.020–0.080% by weight<br>balance iron |

Steels of this kind which are often micro-alloyed with Nb or V have hitherto been very liable to crack formation. Moreover, the method of the invention has proved particularly suitable for wide slabs having a width of more than 500 mm, which as well have hitherto been very liable to crack formation.

The method of the invention may be used both in vertical casting plants and in arc-shaped casting plants. The maintainance of the appropriate temperature on the strand surface is suitably checked optically and is controlled by varying the cooling water quantity.

The method of the invention will now be illustrated in more detail by way of the following example:

An unalloyed killed mild steel was cast in an arc-shaped continuous casting plant to form a strand having the dimensions of 1500 × 225 mm. The lowering speed was 1.2 m/min. The mold was oscillated at 60 strokes/min, which resulted in a distance between the oscillation marks of 20 mm. Over a length of 10 m the strand surface had a temperature of 1130°C and more. Thus every point of the strand surface had been exposed to that temperature for 8 min. The amount of water spent for cooling was 0.7 liters per kg of steel. Although the unsupported length between the rollers in that range of the strand which had a liquid core was only 200 mm, cracks up to 2 mm deep could be observed in the oscillation marks of the continuously cast slabs.

Subsequently the method of the invention was applied in the same casting plant. The dimensions of the mold, the composition of the steel and the lowering speed were the same as with the strand cast previously. The cooling of the strand was increased to 0.9 liters per kg of steel, whereby the surface temperature of the strand in the casting plant was lowered to less than 1100°C. It lay between 900 and 1050°C. At the same time the oscillation frequency was increased to 90 strokes/min. The distance between the oscillation marks turned out to be 13 mm. Thus the conditions characterizing the method of the invention were observed. The slabs were free from cracks in the oscillation marks.

What we claim is:

1. A method of continuously casting a steel strand, for example a slab, in a continuous casting plant, wherein the strand which has a certain temperature is withdrawn from a cooled oscillating mold and is lowered at a certain lowering speed, said mold oscillating at a certain oscillation frequency, whereby oscillation marks distributed at certain distances over the strand surface are formed, and wherein the strand is further cooled in a secondary cooling zone arranged to follow the mold, the improvement comprising the step of coordinating the oscillation frequency of the mold and the lowering speed of the strand with each other so that the oscillation marks occur only within a certain maximum distance from each other, the distance of the oscillation marks being defined as the quotient of the lowering speed in meters per minute to the mold frequency in strokes per minute and amounting to maximumly 0.018 meters.

2. A method as set forth in claim 1, wherein the distance of the oscillation marks amounts to maximumly 0.015 m.

3. A method as set forth in claim 1, wherein the lowering speed lies between 0.8 and 2.0 m/min.

4. A method as set forth in claim 1, wherein the oscillaton frequency of the mold lies between 30 and 150 strokes/min.

5. A method as set forth in claim 1, wherein cooling of the strand is controlled in such a way that when the strand emerges from the mold the temperature at any point on the strand surface is maximumly 1100°C.

6. A method as set forth in claim 5, wherein, in case the temperature of the strand surface is higher than 1100°C, when the strand emerges from the mold, said temperature falls to maximumly 1100°C within maximumly 2 minutes.

7. A method as set forth in claim 1, wherein the strand, as long as it has a liquid core, is supported at distances of maximumly 280 mm by means of supporting-and guiding rollers.

8. A method as set forth in claim 7, wherein the strand is supported at distances of maximumly 250 mm.

9. Use of the method set forth in claim 1 for casting steels having the following composition:

| | |
|---|---|
| C<br>0.09–0.24% by weight | Si<br>0.10–0.40% by weight |
| Mn<br>0.80–1.50% by weight | P<br>0.008–0.030% by weight |
| S<br>0.008–0.030% by weight | Al<br>0.020–0.080% by weight<br>balance Fe, and<br>incidental impurities. |

10. Use of the method set forth in claim 9, wherein the steels are micro-alloyed with Nb.

11. Use of the method set forth in claim 9, wherein the steels are micro-alloyed with V.

* * * * *